US005316285A

United States Patent [19]

Olson et al.

[11] Patent Number: 5,316,285

[45] Date of Patent: May 31, 1994

[54] SHEET MEDIA REALIGNMENT MECHANISM

[75] Inventors: Allan G. Olson, Camas; James O. Beehler, Brush Prairie, both of Wash.

[73] Assignee: Hewlett-Packard Company, Palo Alto, Calif.

[21] Appl. No.: 55,629

[22] Filed: Apr. 30, 1993

[51] Int. Cl.[5] ..... B65H 3/52

[52] U.S. Cl. ..... 271/122; 271/121; 271/244; 271/245; 271/902

[58] Field of Search ..... 271/121, 122, 225, 245, 271/902, 243, 244

[56] References Cited

U.S. PATENT DOCUMENTS

| | | | |
|---|---|---|---|
| 4,526,358 | 7/1985 | Ura et al. . | |
| 4,779,861 | 10/1988 | Ozawa et al. | 271/122 X |
| 4,819,927 | 4/1989 | Noguchi et al. . | |
| 5,000,594 | 3/1991 | Beehler et al. . | |
| 5,090,675 | 2/1992 | Nagai et al. | 271/122 X |
| 5,114,134 | 5/1992 | Rasmussen et al. . | |

FOREIGN PATENT DOCUMENTS

| | | | |
|---|---|---|---|
| 267234 | 11/1991 | Japan | 271/121 |
| 272923 | 12/1991 | Japan | 271/121 |

*Primary Examiner*—D. Glenn Dayoan
*Assistant Examiner*—Boris Milef

[57] ABSTRACT

A sheet media realignment mechanism is described for use in, for example, a printer. Preferably, the mechanism includes a lever located in the sheet-feeding path adjacent and beneath a rotatable member that mounts a plurality of sheet-feeding rollers. At the beginning of a sheet-feeding cycle, the lever is urged from its extreme upstream pivotal orientation by a pivot-mounted strut into a downstream orientation in which a top sheet of the printer's infeed stack is fed by frictional forces into the feed zone. Upon release of the lever by the strut at a predefined pivotal orientation of the rotatable member, the lever is urged farther into an extreme downstream orientation by the sheet being advanced. After the sheet passes by, the lever is returned to its extreme upstream orientation in which it urges upstream and away from the printer's feed zone any sheets of the stack that inadvertently may have been dislodged and partly advanced downstream and toward the feed zone by frictional forces between the fed sheet and those beneath it. Thus, the lever realigns the sheets of the paper stack after each single-sheet feed into the printer or other sheet media-processing equipment to permit the addition of sheets to the top of the stack without pulling the stack away from the feed zone and to reduce the likelihood of undesirable multiple-sheet picks and feeds.

13 Claims, 5 Drawing Sheets

SHEET MEDIA REALIGNMENT MECHANISM

TECHNICAL FIELD

The present invention relates generally to paper or other sheet media-feeding mechanisms. More particularly, the invention relates to equipping a sheet-feeding subsystem that is subject to inadvertent multiple sheet picks with a pivotal 'kick' lever that automatically realigns the leading edges of the top sheets in the paper sheet infeed stack, thereby better to control single sheet feeding.

BACKGROUND ART

Previously, inadvertent multiple picks of the top few sheets of paper in an infeed mechanism have been reduced to some extent by, for example, supplying a frictional force against those sheets beneath the top sheet in the infeed stack. One such mechanism is described in co-pending U.S. patent application Ser. No. 07/954,541 entitled "Paper Pick-up System for Printers", which was filed Oct. 29, 1992, and which is subject to common ownership herewith. Described therein is a pivotally-operable, spring-returnable separator located adjacent and beneath the infeed rollers of a sheet pick mechanism of an ink-jet printer, the separator having a wear-resistant, upstanding portion rearwardly adjacent a frictionally adherent pad. The separator's pad opposes advancement of a next-to-top sheet in the infeed paper stack while the top sheet of the stack is pulled thereacross by one or more rollers. While such a separator pad is effective in opposing advancement of a next-to-top sheet, there typically remains undesirable advancement, of the media sheets below the top sheet that has just been advanced for printing, toward the feed zone, resulting in an uneven leading, or 'downstream', or 'forward', top edge of the paper sheet stack.

Co-pending U.S. patent application Ser. No. 08/055,627 entitled "Sheet Media Feed System", filed Apr. 30, 1993 by co-inventors Allan G. Olson, Robert K. Beretta, Michael K. Bowen and James O. Beehler, and subject to common ownership herewith, describes an improved paper sheet infeed mechanism that selectively brings a separator from an at-rest position into engagement with the sheet media so as to effect pick-up of a single sheet. Once the sheet is picked, and before further downstream processing (e.g. printing) begins, the separator is returned to its at-rest position until the next sheet is to be picked. Reliable delivery of sheet media to the input port, e.g. of a printer, is thus effected by moving the separator away from the sheet media to enable the invented realignment mechanism described herein to operate. The disclosure of that application is incorporated herein by this reference.

Slidable stacked-paper input trays for printers have been proposed, wherein the trays have manual means for grippingly capturing the entire paper stack when the tray is pulled away from the printer's feed zone. Such an improved tray is described in co-pending U.S. patent application Ser. No. 07/954,766 entitled "Printer Paper Pullout Apparatus", filed Sep. 30, 1992 and subject to common ownership herewith. The paper capture means described and illustrated therein is marginally effective in preventing multiple picks, since the top few unevenly advanced sheets also are captured and removed from the feed zone. Unfortunately, it requires that the tray be fully extended any time it is desired to add paper to the tray.

DISCLOSURE OF THE INVENTION

The invented sheet realignment mechanism includes a 'kick' lever located in the sheet-feeding path adjacent and beneath a pivot that mounts a plurality of sheet-feeding rollers. At the beginning of a sheet-feeding cycle, the lever is urged by a pivot-mounted strut from a relatively 'rearward', or 'upstream', nominal rest position and orientation within the feed zone into a relatively 'forward', or 'downstream', position and orientation free of the feed zone in which a top sheet of the infeed stack is fed by frictional forces into the feed zone. Upon release of the lever by the strut at a predefined pivotal orientation of the pivot, the lever is urged farther into an extreme downstream position and orientation by the sheet being fed. After the sheet passes by, the 'kick' lever returns by spring force to its nominal rest position and orientation in which it kicks, or urges, upstream—away from the feed zone—any sheets of the stack that inadvertently may have been dislodged and partly advanced toward the feed zone by frictional forces between the fed sheet and those beneath it.

Thus, the lever realigns the sheets of the media stack after each single-sheet feed into the input port to reduce the likelihood of undesirable multiple-sheet feeds, or picks. The invented sheet realignment mechanism is described for use in a printer, but is applicable more broadly to any low-cost equipment in which sheet media are desired to be singly picked for further downstream processing in a 'forward' direction of sheet medium advancement. The mechanism is inexpensive and easily maintained. Importantly, the invented mechanism makes it possible to avoid sheets' being partially captured in the feed zone, and permits the addition by an operator of, for example, a printer of one or few sheets to the top of an existing paper stack without pulling the stack away from the feed zone.

These and additional objects and advantages of the present invention will be more readily understood after a consideration of the drawings and the detailed description of the preferred embodiment.

DETAILED DESCRIPTION OF THE PREFERRED EMBODIMENT AND BEST MODE OF CARRYING OUT THE INVENTION

Figure 1:
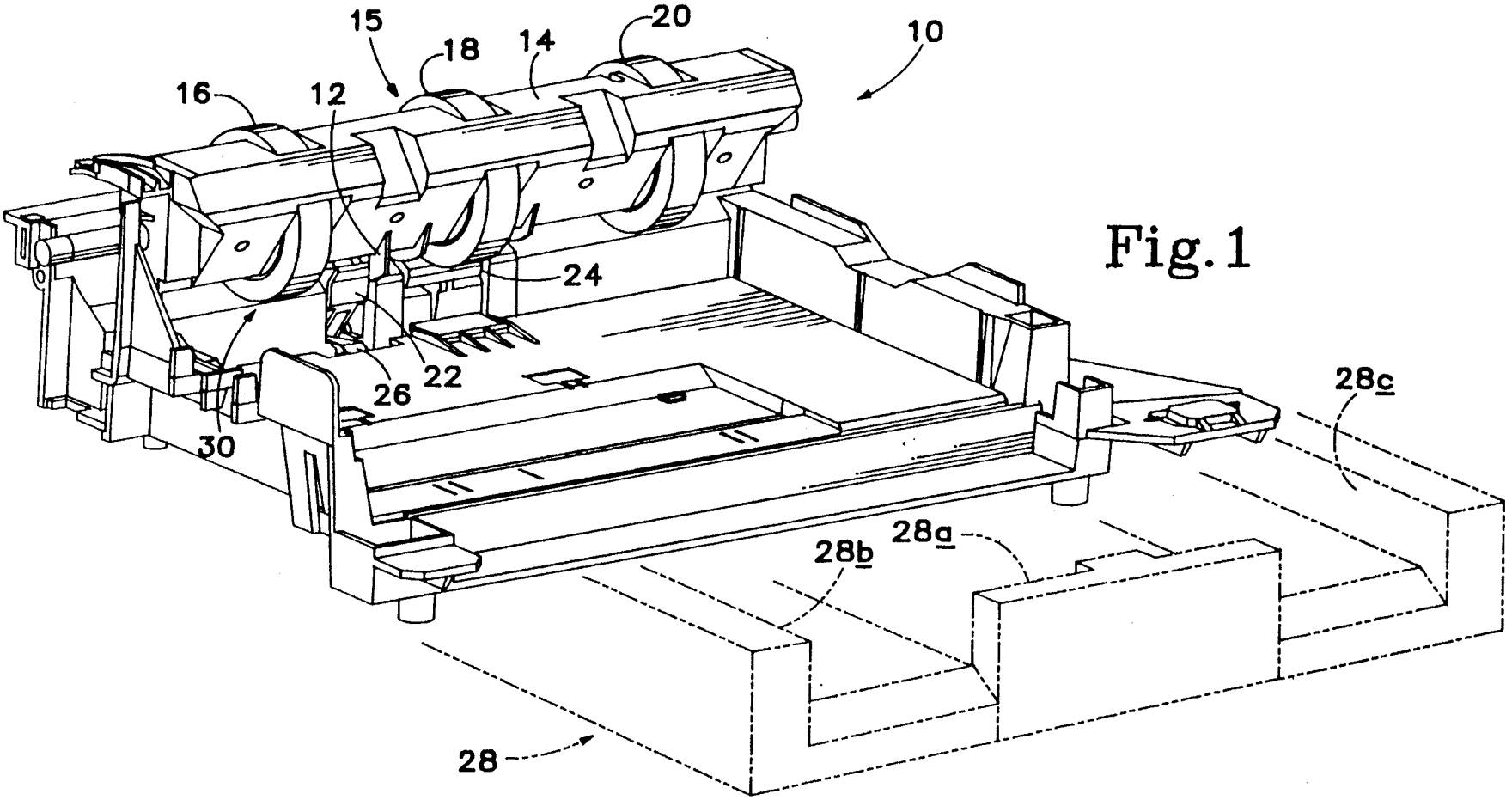
FIG. 1 is an isometric view of a single-sheet infeed subsystem for a printer, showing the invented paper realignment mechanism made in accordance with its preferred embodiment.

Referring first to FIG. 1, the invented sheet realignment mechanism made in accordance with its preferred embodiment is indicated generally at 10, with an application-illustrative printer infeed tray shown in dash-dot-dot lines. It will be appreciated that the dashed-line features of the printer are for illustrative purposes only, and are not intended to limit the invention to ink-jet or any other type of printer. The invented mechanism is useful in any relatively low-cost, single-sheet media feeding subsystem, whether in a printing, faxing, copying or other application wherein it is desired to be able to add one or more sheets to the top of an existing stack without adverse effect on single-sheet picking and feeding, and wherein it is desired to feed single sheets from a edge-aligned stack thereof for further downstream processing without multiple picks and feeds of such single sheets.

Figure 2:
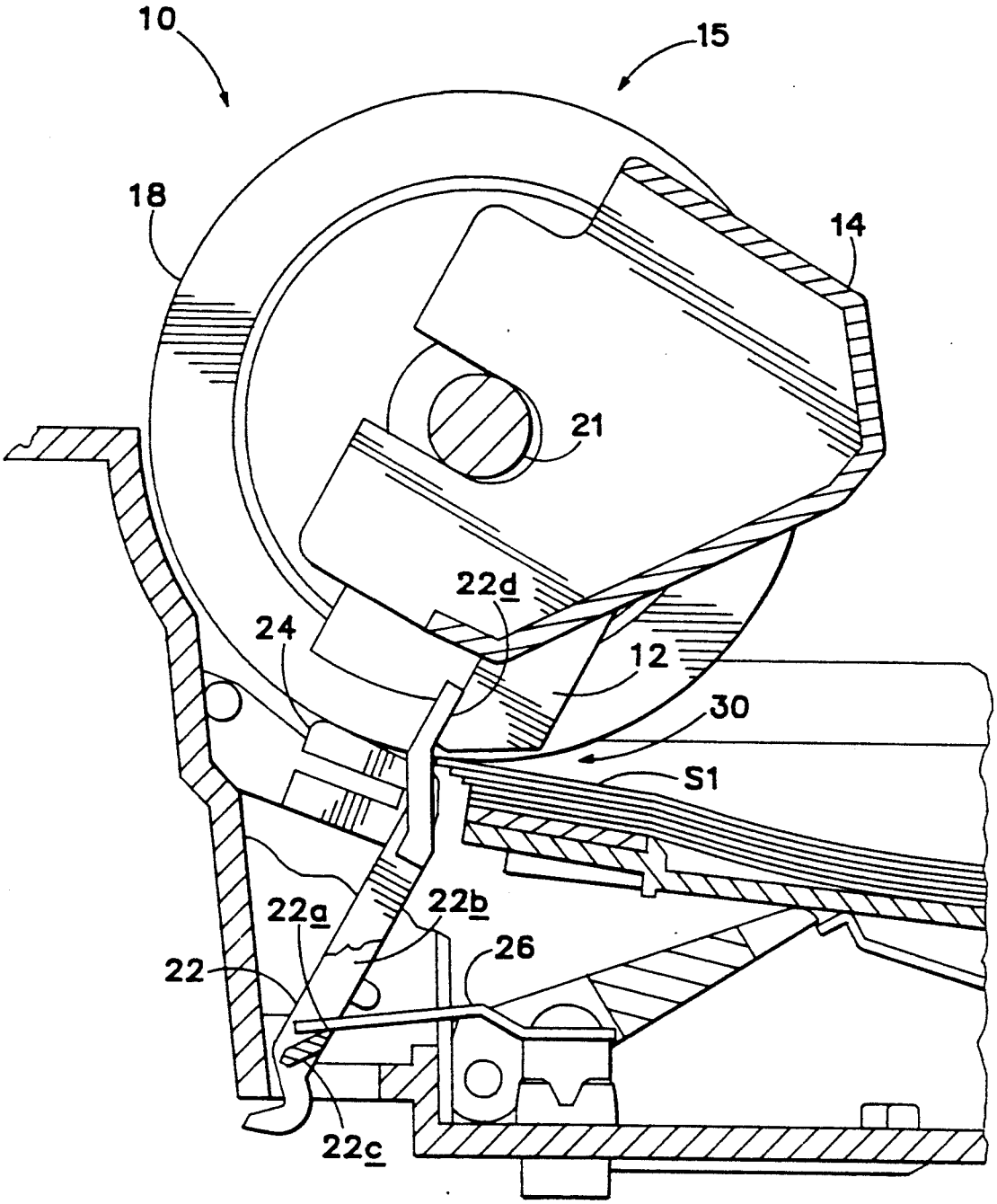
FIG. 2 is a fragmentary, sectional, side elevational view of the mechanism in a first phase of its operation in which a top sheet of the stack is picked for printing.

Referring now to FIG. 2, it may be seen that mechanism 10 preferably includes a strut 12 that operates with and extends a predetermined radial distance from and normal to a central axis of a preferably pivotable member 14, referred to herein also simply as a pivot. Pivotable member 14 preferably operatively is coupled, for partial or predeterminedly selective rotation, with a rotatable sheet pick/feed member 15 including one or more sheet-feeding rollers such as triple, laterally spaced rollers 16, 18, 20. Rollers 16, 18, 20 are mounted for rotation on a common shaft 21, which shaft 21 is rotatably driven by a driver such as a stepper motor (not shown). Pivotable member 14 with which strut 12 moves is operatively connected to pick/feed member 15, for selective (unidirectional, limited-extent) rotation therewith, by a clutch (also not shown). It will be understood that pivotable member 14, pick/feed member 15, driver and clutch are conventional, and may be implemented in any suitable manner such as that described and illustrated in U.S. Pat. No. 5,000,594 entitled "Printer with Carriage-Actuated Clutch and Paper-Feed Mechanism", subject to common ownership herewith.

Along with invented strut 12, mechanism 10 also preferably includes a lever 22 that is pivotable in an arc (as illustrated by contrasting FIGS. 2 through 5) that sweeps through a fraction of a volume defined by rotatable member 15, e.g. a cylindrical volume defined by rollers 16, 18, 20. (It will be understood that rotatable member as used herein is to be interpreted broadly to include, for example, a belt-type sheet pick/feed member or other suitable sheet medium-advancing means.) Mechanism 10 also preferably includes a separator pad 24 closely adjacent and beneath one of the rollers such as center roller 18, with pad 24 preferably being located laterally adjacent lever 22. Lever 22 is suitably chassis mounted at its pivotal axis A (refer to FIG. 3), as suggested in FIGS. 2 through 5, for pivotal movement through an arc limited by its extreme rearward position illustrated in FIG. 1, with its rearward position representing a nominal position in which lever 22 normally is maintained, preferably by a chassis-mounted cantilever beam spring 26. (It is noted that the hook feature beneath pivotal axis A of lever 22 serves no purpose in the operation of the invented mechanism—it is used during product testing as part of the manufacturing process.)

Figure 3:
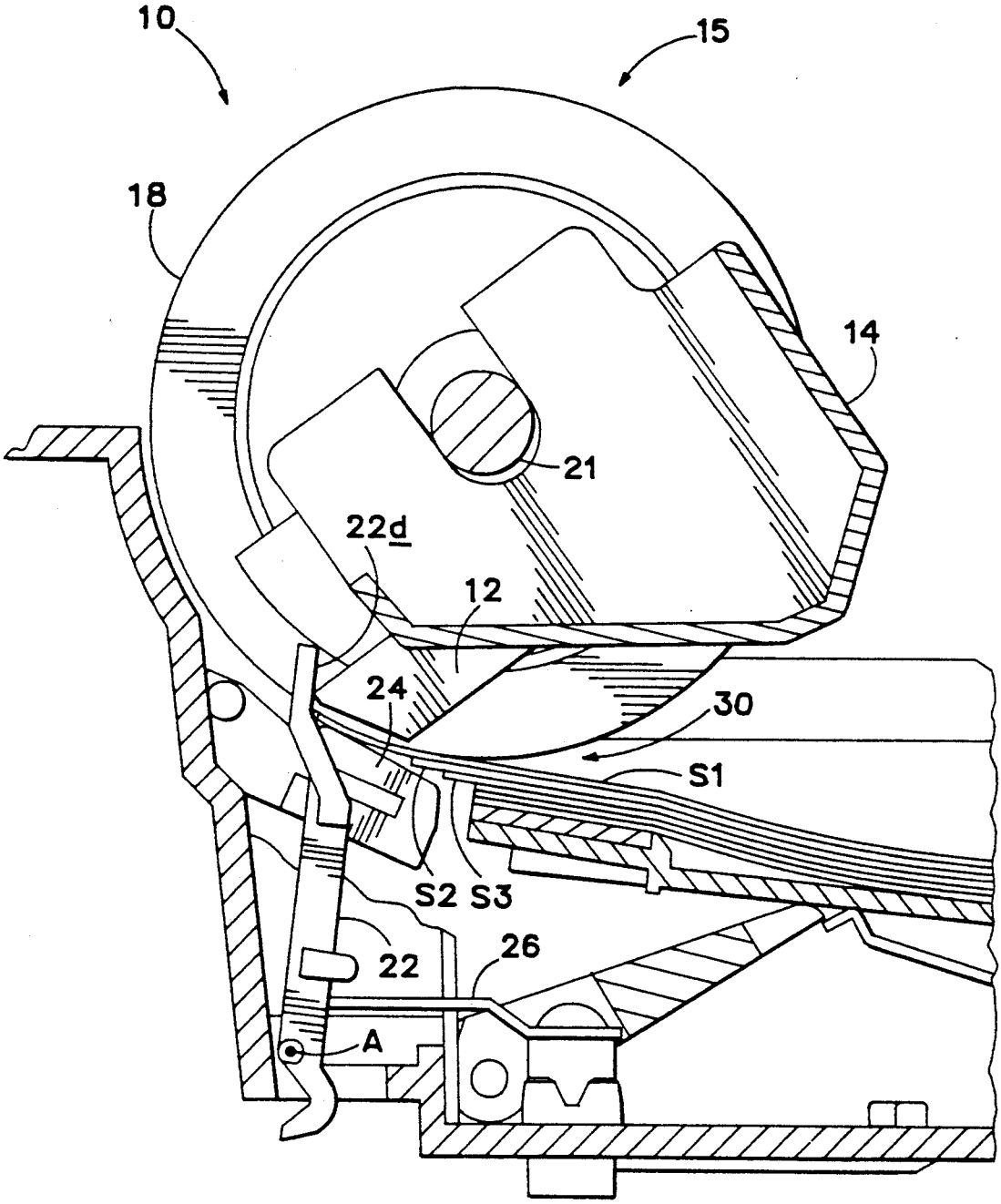
FIG. 3 is a view of the mechanism similar to that of FIG. 2, but showing a second phase of its operation in which the lever is urged forwardly by the pivot-mounted strut.
Figure 4:
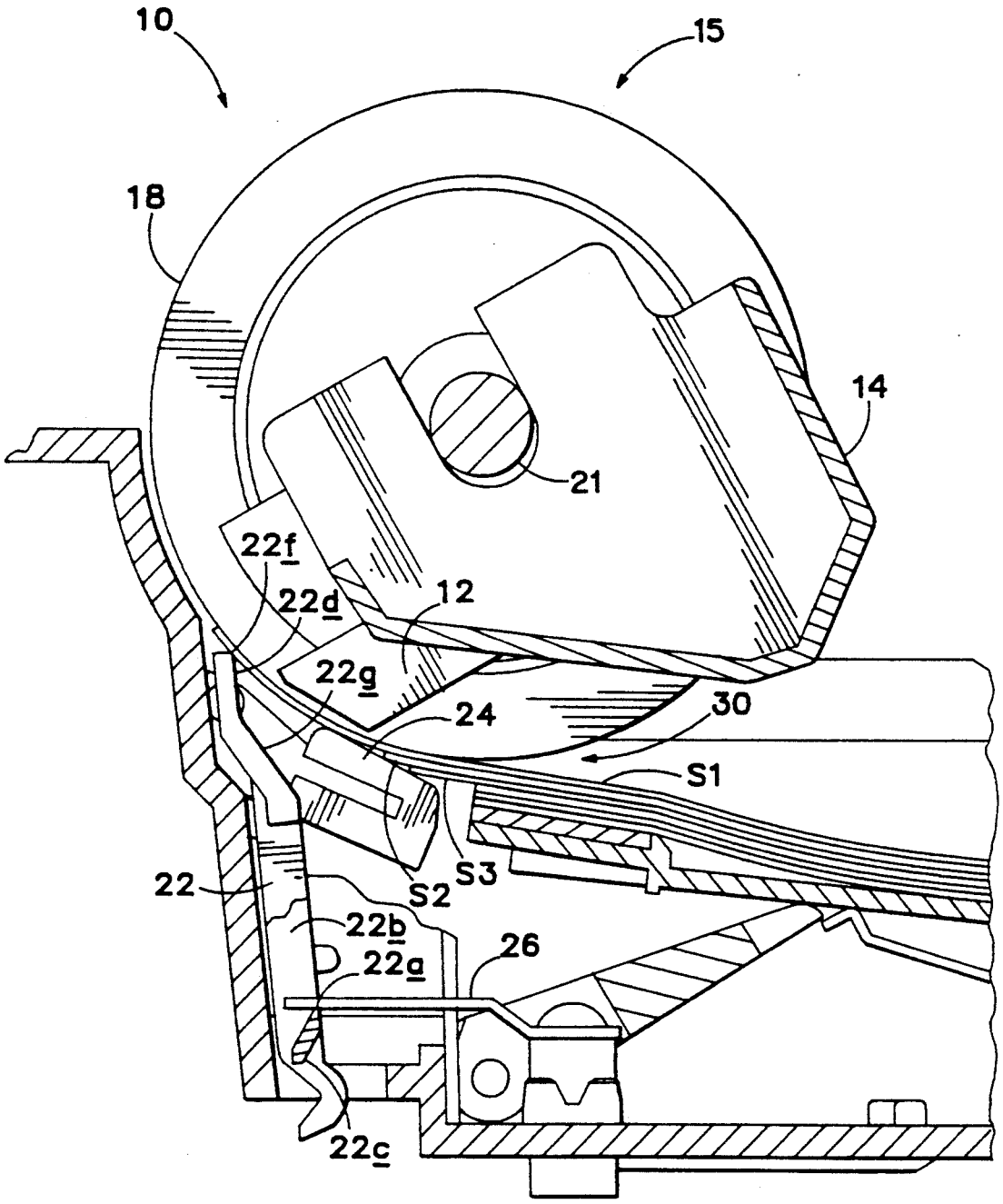
FIG. 4 is a view of the mechanism similar to that of FIGS. 2 and 3, but showing a third phase of its operation in which the lever is urged farther forwardly by a top sheet during a feed cycle.
Figure 5:
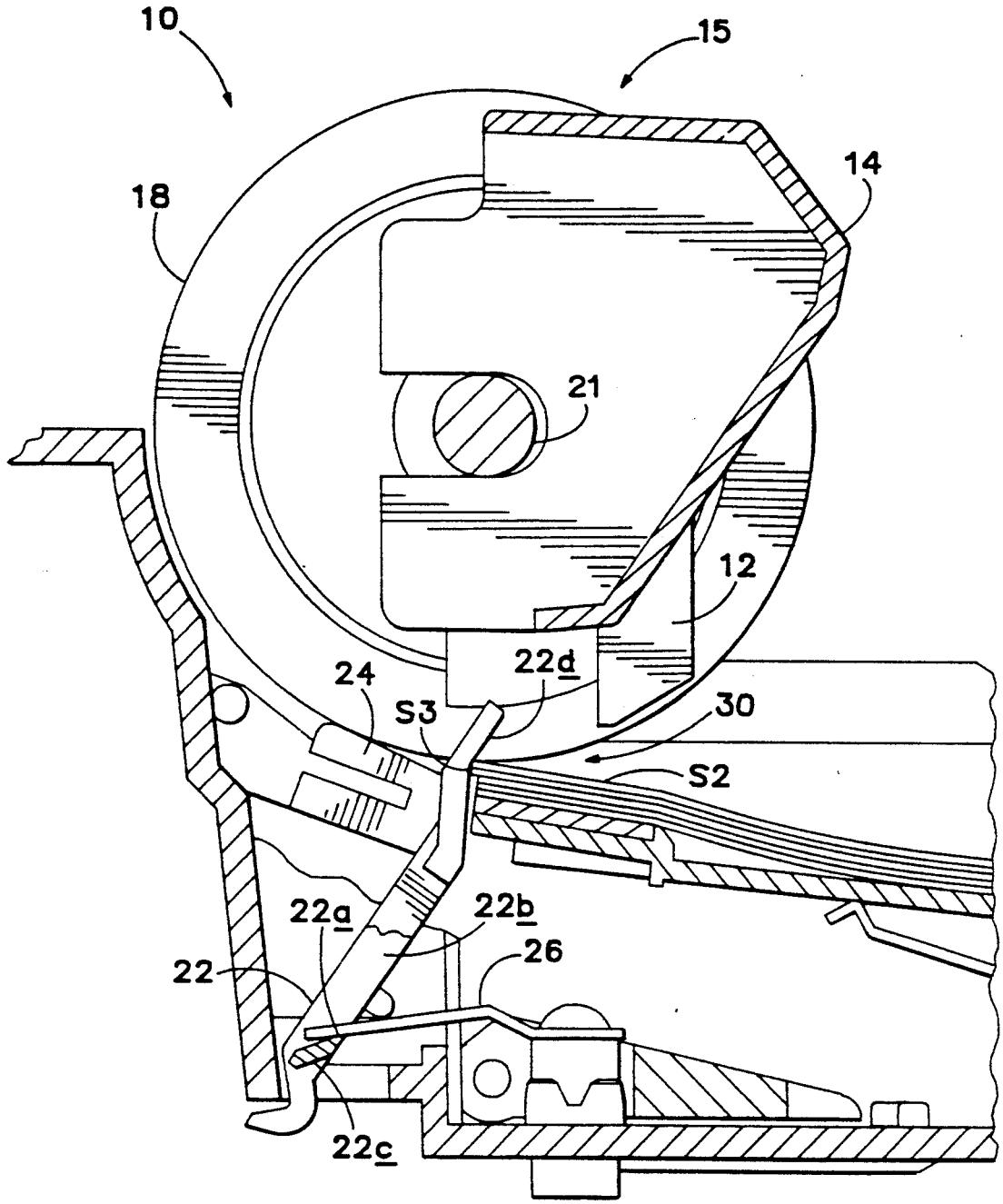
FIG. 5 is a view of the mechanism similar to that of FIGS. 2 through 4, but showing a fourth phase of its operation in which the lever is spring-returned to a rearward position to realign the top few sheets of the stack.

It may be seen best from FIG. 2 that preferably a forward, terminal region of spring 26 impacts downwardly on a preferably smoothly rounded upper edge region **22*a*, within a channel region 22*b* of lever 22, of upwardly and slightly rearwardly extending arm 22*c* of lever 22, as indicated in a sectional, breakaway view in FIGS. 2, 4 and 5. This provides a desirably variable torque, or pivotal force, to lever 22 depending upon its pivotal orientation. When lever 22 is biased, or urged, rearwardly against the sheet media stack, as suggested by FIG. 2, it is so urged with a relatively greater force. By contrast, when lever 22 is biased, or urged, forwardly by advancing top sheet S1, as shown in FIG. 4, it is so urged with a relatively lesser force. This results from the fact that as lever 22 pivots through its prescribed operational arc, arm 22*c* does so also, thereby varying the length of the moment arm at the end of which beam spring 26 impacts arm 22*c* to urge lever 22 to pivot (in a clockwise direction in FIGS. 2 through 5**).

Advantageously, lesser force is applied by lever 22 against a top-of-stack sheet media S1 being fed therepast, when lever 22 is in its forward or downstream position shown in FIG. 4 (thus better protecting the relatively fragile leading edge and lower surface of the sheet media, which may be paper, mylar of other sheet material), and substantially greater force is applied thereby against a top few sheet media being realigned thereby, when lever 22 is in its rearward or upstream position shown in FIG. 2 (thus more strongly urging the top few sheets back into vertical alignment on the sheet media stack).

Those of skill in the art will appreciate that other variable-force return mechanisms may be used, within the spirit and scope of the invention. Persons skilled in the art also will appreciate that return mechanism may be implemented differently, yet within the spirit and scope of the invention. For example, lever 22 alternatively may be actively driven by suitable means in both directions through a predetermined path between its upstream and downstream positions and orientations, whether with constant or variable forces in the downstream (forward) and upstream (rearward) directions. It is particularly in low-cost applications of the invention (or in installed-base retrofit applications) wherein a simple spring is used as a return mechanism that a cantilever beam spring acting with variable force on the lever is desired. Otherwise, lever 22 reciprocally could be driven by any suitable means downstream to a position and orientation that is clear of the defined cylinder and free of top sheet medium S1 and upstream to a position and orientation that traverses the defined cylinder and impacts on next-to-top-of-stack sheet media, thereby restoring their leading edges to leading-edge alignment with the sheet media stack.

In a first phase of its operation shown in FIG. 2, mechanism 10 is in the condition shown in FIG. 1 in which a top sheet S1 of a sheet media, e.g. paper or mylar, stack situated in an infeed tray 28 is intaken into a feed zone 30 defined beneath member 15, i.e. top sheet S1 is picked for printing. In this illustrated orientation of pivotal member 14, strut 12 extends at a predefined angle that may be seen to lead the leading edge of top sheet S1 by a few degrees. Top sheet S1 is frictionally pulled, or advanced, downstream into feed zone 30 by engagement of its leading edge by rollers 16, 18, 20. Simultaneously, by the action of the clutch that operatively, selectively connects pivotable member 14 with rotatable member 15, member 14 begins to pivot through a defined angle determined by the clutch.

Helpfully illustrating the invented solution to the problem with prior art infeed mechanisms, a second-to-top sheet S2 and a third-to-top sheet S3 are dislodged from the sheet media or paper stack and are advanced downstream somewhat—due to frictional forces between vertically adjacent sheet—toward feed zone 30, with sheet S2 typically being advanced somewhat more than sheet S3. Although this advancement may not result immediately in a multiple-sheet pick because of the advancement-retarding effect of pad 24, it will be appreciated that such advancement often is cumulative through successive media feed cycles and that in any event such advancement or forward 'creep' of the top few sheets toward feed zone 30, whether cumulative or not, leaves the top forward or downstream edge of the media stack within tray 28 uneven. This resulting uneven edge, if not corrected by the invented realignment mechanism, would produce undesirable consequences to the subsequent operation of the printer and to the convenience of its operator.

Turning next to FIG. 3, a second phase of the operation of mechanism 10 is shown in which lever 22 is urged forwardly (against its rearward bias, e.g. against its return spring 26 bias) by strut 12 as member 15 is rotated farther by the drive mechanism. At this pivotal orientation of member 14, it may be seen that top sheet S1 has been advanced by the rotation of member 15 and by frictional engagement with rollers 16, 18, 20, but that its leading edge still is rearward or upstream of lever 22. It also may be seen that lever 22 has not quite reached the extreme forward limit of its pivotal arc. Again, sheets S2 and S3 have slightly incrementally advanced or 'crept' downstream toward feed zone 30, although pad 24 opposes such undesirable advancement.

FIG. 4 shows mechanism 10 in a next phase of its operation in which top sheet S1 has urged lever 22 into its farthest forward arcuate position. From FIG. 3 it may be seen that member 14 has pivoted substantially from its angular orientation shown in FIG. 3, along with strut 12 connected thereto. Because of the orientation and dimension of strut 12, its distal end **12*a* does not interfere with the circular movement of top sheet S1 as it is fed for printing. Preferably, strut 12 extends substantially radially with its elongate axis normal to the central axis of rotatable member 15. Also preferably, strut 12 is dimensioned in length to be approximately equal to, and more preferably slightly less than, the radius of the cylinder defined by rollers 16, 18, 20. This maximizes its reach for engaging and urging lever 22** but reduces its interference with the advancement of top sheet S1 during the downstream processing, e.g. printing, thereof.

The preferred complex structure of lever 22 may be seen from FIG. 3 to provide a generally orthogonal sheet-confronting region **22*d* adjacent its distal end. It will be appreciated that region 22*d* first confronts strut 12 and later confronts a single-sheet medium preferably at an approximately right angle to minimize stress on the distal ends of lever 22 and strut 12, and to minimize damage to top sheet S1 as it is fed through feed zone 30 for downstream processing such as printing. Preferably, the extreme distal end of lever 22 is smoothly rounded on both its contacting edge 22*f*, thereby more smoothly to be passed by top sheet S1, without creasing, scoring or other adverse effect on sheet S1. These structural details of lever 22, when coupled with the operationally lowtorque urging of lever 22 by spring 26 when lever 22** is in its extreme forward position of confrontation with sheet S1, have been shown to facilitate single-sheet medium feeding without damage to the single sheet medium.

It may be seen from FIG. 4 that sheet S2 has advanced farther toward feed zone 30 due to frictional forces between advancing sheet S1 and S2, which ideally would not have advanced. The leading edge of sheet S2 now is barely rearward or upstream of feed zone 30, and further advancement of sheet S2 risks its entry thereinto and possible inadvertent picking and feeding of sheet S2 while sheet S1 is in process, e.g. being printed. It also may be seen that sheet S3 also has advanced close to feed zone 30 due to frictional forces impacting thereon by inadvertently and undesirably advancing sheet S2.

Turning finally to FIG. 5, it may be seen that as the trailing edge of sheet S1 clears lever 22, lever 22 is urged into its nominal rearward or upstream, rest position by spring 26. Importantly, during its return arcuate travel from its extreme forward position shown in FIG. 4 to its extreme rearward position shown in FIG. 5, lever 22 smoothly has confronted the uneven leading edges of sheets S2, S3 with sufficient force to urge them rearwardly away from feed zone 30 into a more desirable, leading edge-aligned, stacked orientation atop the sheet media stack within infeed tray 28. In this stacked orientation in which the leading edges of sheets S2, S3 are even with one another and with all other sheets in the stack, equipment such as a printer is ready to begin another sheet-feeding cycle for printing new top sheet S2.

A stack-confronting region **22*g* located inwardly from distal region 22*d* on lever 22 may be seen from FIG. 5 substantially orthogonally to confront the sheet media stack at rest in its nominal position within infeed tray 28. A preferably smoothly rounded juncture, or corner region, that may be thought of as an obtusely angular region of intersection of regions 22*d*, 22*g* confronts next-to-top-of-stack sheet media S2, S3 as they are urged into vertically stacked realignment in accordance with the invention. It has been determined that sheet media S2, S3 typically are confronted by lever 22 in region 22*d* or in the just-defined rounded region such that the media are urged substantially rearwardly along an axis in their planes, and perhaps slightly downwardly, to restore their vertically stacked alignment in tray 28. Because sheet media S2, S3 may be inadvertently advanced by an amount that varies, e.g. with the weight and finish of the sheet media, lever 22 may impact their leading edges throughout a small range of angles and through a corresponding range of locations along region 22*d***.

Generally orthogonally sheet-confronting region **22*d* in its various pivotal orientations of engagement with sheets S2, S3 minimizes the likelihood of urging any sheet upwardly into frictional contact with rollers 16, 18, 20, which might prevent them from being fully realigned, which full realignment is desirable. The above-described corner region between adjacent, confronting, generally planar regions 22*d*, 22*g* is believed to act—over the range of locational and orientational confrontations between the leading edges of sheets S2, S3—to stop the perhaps slidingly confronted sheets' leading edges in a fixed position along the extent of lever 22**, thereby to control the direction in which they are urged as lever spring-returns to its extreme rearward position wherein its region 22*d* rests in substantially co-planar relation with the aligned leading edges of the sheets in the media stack.

It may be seen from FIGS. 1 and 5 that the generally mid-lateral placement of lever 22 relative to the average width of the sheet media within tray 28 (see FIG. 1) cause undesirably advanced sheets S2, S3 near the top of the stack to glide rearwardly (see FIG. 5) against a rearward stop expanse 28*a* (see FIG. 1) in substantially lateral alignment with the sheet media stack, with one or both lateral edges against one or both of lateral tray guide members 28*b*, 28*c* (see FIG. 1). FIG. 5 will be understood to illustrate this rearward movement at a moment in time before lever 22 reaches its extreme rearward stop position and orientation.

Broadly speaking, invented sheet media realignment mechanism 10 will be understood to be for useful in any stacked sheet feeding equipment that includes a single sheet pick/feed mechanism, e.g. pick/feed mechanism 15, for feeding a single sheet from the top of a sheet media stack through a feed zone, e.g. feed zone 30. In this context, the invented realignment mechanism may include a first member, e.g. lever 22, adjacent the pick-/feed mechanism and controllably moveable between a first position free of the feed zone (refer to FIG. 4) for unobstructed feeding of a top sheet therethrough and a second position within the feed zone and adjacent the sheet media stack (refer to FIG. 5). Such first member preferably includes a sheet media-confronting expanse, e.g. one or both of smoothly, angularly confronting expanses 22*d*, 22*g*, for guiding next-to-top sheets in the stack upstream into leading edge alignment with the remaining sheets in the stack.

The realignment mechanism also includes a control mechanism operable synchronously with the pick/feed mechanism to move the first member from the first to the second position after the feeding of a single sheet through the feed zone, thereby to restore leading edge alignment of remnant sheet media in the stack. This claimed control mechanism will be understood by those skilled in the art to be implemented in the preferred embodiment in controlledly rotatable strut 12 for moving lever 22 into such first position and beam spring 26 cooperating with arm 22*a* for moving lever 22 into such second position. Alternative embodiments are possible. For example, the first member need not be pivotal, nor need it be driven into its first position by a rotatable strut, nor need it be driven into its second position by a return spring. Instead, the first member might be simply reciprocally driven by suitable means alternately into the first and second positions, as by a separate drive mechanism synchronously controlled with the drive for the pick/feed mechanism.

As described and illustrated herein, in accordance with the preferred embodiment of the invention, the pick/feed mechanism is rotated by a drive mechanism, and the first member is pivotable between the first and the second positions. Also in accordance with the preferred embodiment described and illustrated herein, the realignment mechanism includes a second member operatively connected with the pick/feed mechanism for selected rotation therewith, e.g. unidirectionally and through the illustrated, limited rotational angle. The second member selectively engages the first member to urge the latter into the first position, and the control mechanism further includes a return mechanism for urging the first member into the second position after a top sheet has been fed by the pick/feed mechanism downstream past the first member.

Invented sheet media realignment mechanism 10 may be understood to include a rotatable sheet pick/feed mechanism or member 15 defining adjacent thereto single sheet media feed zone 30, with the pick/feed mechanism including one or more rotatably moveable, frictional expanses, e.g. the cylindrical outer surfaces of rollers 16, 18, 20, for engaging a top sheet in a plural-sheet media stack. Mechanism 10 also includes a pivotable member, e.g. member 14, operatively coupled with the pick/feed mechanism for at least partial rotation therewith. Member 14 has operatively connected therewith a generally radially extending strut 12. In accordance with the preferred embodiment of the invention described and illustrated herein, strut 12 extends radially outwardly normal to a central rotational axis of member 14 to an extent that is approximately equal to a radius defined by such cylinder.

Mechanism 10 further includes a drive mechanism (e.g. a motor equipped with a clutch and controlled by the printer's controller, not shown) for rotating pivotable member 14 with a predefined first force into various predefined rotational orientations of the pivotable member including a first sheet-feeding orientation such as that illustrated in FIG. 2.

Importantly, invented mechanism 10 further includes a preferably pivotal lever 22 extending into feed zone 30, with the lever nominally traversing the feed zone, as best shown in FIGS. 2 and 3. Lever 22 is temporarily urged by the strut, upon rotation of pivotable member 14 (e.g. by its clutch-driven coupling with rotatable pick/feed mechanism 15), into a non-obstructing orientation that permits feeding by the member of a top sheet S1 of the stack by engagement thereof with the frictional expanses. Also importantly, invented mechanism 10 further includes a return mechanism, e.g. beam spring 26 cooperating with rearwardly inclined arm 22*c* mounting pivotal post 22*a* within channel region 22*b*, operatively connected with the lever for returning the same to the nominally obstructing position within the feed zone upon rotation, by the drive mechanism, of pivotable member 14 into the first orientation.

It will be appreciated that invented mechanism 10 operates in such manner that the lever urges media sheets, e.g. sheets S2 and S3, below the top sheet, e.g. sheet S1, into substantially vertically stacked alignment free of the feed zone, thereby preventing them from inadvertently being picked and fed downstream. As is pointed out above, invented mechanism 10 preferably further includes a separator pad, e.g. pad 24, closely adjacent the frictional expanses when the rotatable member is in the first orientation, said pad having a friction-promoting upper surface for substantially opposing advancement, into the feed zone, of the media sheets S2 and S3 below the top sheet S1. Preferably, the pad and the lever are laterally adjacent one another, as best shown in FIG. 1.

In accordance with the preferred embodiment of the invention, the rotatable member includes one or more spaced rollers equipped on their cylindrical outer perimeters with the referenced frictional expanses. Of course, it will be appreciated that, within the spirit and scope of the invention, one or more belt conveyers providing such frictional expanses may serve.

As best may be seen from FIGS. 2 through 5, lever 22 preferably is dimensioned and oriented such that a distal end thereof pivots in an arc that sweeps a fractional volume of a cylinder defined by the rollers. The return mechanism will be understood to provide a second predefined force through such intersecting pivotal arc, wherein the second predefined force is less than the first predefined force at a downstream terminal pivotal arcuate position of the lever. Importantly, this permits top sheet S1 while present during feeding thereof to urge lever 22 into pivotal position such that its distal end is positioned substantially tangent to such cylinder. Also preferably, the second predefined force is variable through such arc, thereby providing differential torque at the two extreme (forward, or downstream, and rearward, or upstream) orientations of, or positions of distal end, of lever 22.

Thus, it may be seen that invented realignment mechanism 10 represents an improvement on conventional sheet media pick/feed mechanisms for use in low-cost printers, facsimile machines and copiers having a single-sheet feed mechanism for feeding a top sheet from a vertical stack of plural such sheets by rotation of two or more laterally spaced rollers defining a cylinder and selectively engaging such top sheet. The improvement includes 1) a radially extending first member, e.g. strut 12, rotatably disposed adjacent one such roller, with the first member extending outwardly normal to a central axis of such cylinder with its distal end within the radius thereof; 2) a lever, e.g. lever 22, pivotally connected to the printer's chassis, with the lever being in lateral alignment with the first member, as perhaps best illustrated in FIG. 1, and with the lever nominally extending into such cylinder for engagement by the first member when such rollers are in a first predefined rotational orientation, a distal end of the lever being moved by the first member downstream to a position generally tangent to the outer surface of such cylinder; and 3) a return mechanism active when such rollers are in a second predefined rotational orientation to return the lever to such original position as the trailing edge of a top fed sheet clears the lever, with the lever urging any sheets that may have been advanced downstream by such rotation back into leading edge alignment in the stack.

Preferably, the improvement is implemented such that the return mechanism includes a spring, e.g. cantilever beam spring 26, impacting upon the lever, e.g. upon inclined arm 22*c* thereof, with a variable force thereon such that the lever exerts a lesser return force in a relatively downstream position of said distal end of the lever (refer to FIG. 4) and a relatively greater return force in a relatively upstream position of the distal end of the lever (refer to FIG. 5). The differential torque on lever 22, in accordance with the preferred embodiment of the invention in which a beam spring is used as the return mechanism, renders the improvement capable of handling relatively unsupported, lightweight, and thus fragile, sheet media free and leading edges (see FIG. 4), yet renders it capable of 'kicking', or urging, relatively supported and rigid leading edges (see FIG. 5) back into proper vertically stacked orientation in the input tray of the sheet media equipment.

Invented sheet media realignment mechanism 10 when incorporated in a printer as in the preferred embodiment illustrated herein thus may be seen to promote recurrent media sheet realignment within the printer's sheet infeed stack so that successive sheet-feeding cycles are far less likely to result in multiple-sheet picks, which multiple picks at the very least will cause print quality problems, which multiple picks typically would jam the printer and which multiple picks could even damage the printer. Mechanism 10 includes relatively few, low-cost parts, is relatively simple to operate, as in its preferred embodiment described herein it requires no additional drive mechanism other than a spring, readily can be retrofitted to existing printers and requires little or no maintenance.

INDUSTRIAL APPLICABILITY

Those skilled in the art will appreciate that the invented sheet realignment mechanism is useful in any sheet medium-feeding subsystem such as that of a low-cost printer, facsimile machine or copier in which single sheets are to be picked for feeding and in which multiple picks are possible but undesirable. The invented mechanism is easily incorporated into existing sheet feeding subsystems, has relatively few, preferably molded parts and is inexpensively manufactured and maintained. Importantly, the invented mechanism makes it possible to avoid sheets' being partially captured in the feed zone, and permits the addition by an operator of one or more sheets, e.g. a sheet of stationary, to the top of an existing sheet media stack without requiring that the stack tray be pulled away from the feed zone. Also importantly, the invented mechanism is compatible with the improved mechanism for transporting print media that is described in our incorporated-by-reference, co-pending patent application.

While the present invention has been shown and described with reference to the foregoing preferred embodiment, it will be apparent to those skilled in the art that other changes in form and detail may be made therein without departing from the spirit and scope of the invention as defined in the appended claims.

We claim:

1. A sheet media realignment mechanism for stacked sheet feeding equipment including a single sheet pick-/feed mechanism moveable by a drive mechanism for feeding a single sheet from the top of a sheet media stack through a feed zone, the realignment mechanism comprising:

a first member adjacent the pick/feed mechanism and controllably moveable between a first position free of the feed zone for unobstructed feeding of a top sheet therethrough and a second position within the feed zone and adjacent the sheet media stack, said first member including a sheet media-confronting expanse for guiding next-to-top sheets in the stack upstream into leading edge alignment with the remaining sheets in the stack, and a control mechanism operable synchronously with the pick/feed mechanism to move said first member from said first to said second position after the feeding of a single sheet through the feed zone, thereby to restore leading edge alignment of remnant sheet media in the stack, wherein said control mechanism includes a second member operatively connected with the pick/feed mechanism for selected movement therewith, said second member selectively engaging said first member to urge the latter into said first position, wherein said control mechanism further includes a return mechanism for urging said first member into said second position after the top sheet has been fed by the pick/feed mechanism downstream past said first member.

2. The cechanism of claim 1 in which the pick/feed mechanism is rotated by the drive mechanism, wherein said first member is moved pivotally by said control mechanism between said first and said second positions.

3. A sheet media realignment mechanism in media feed equipment, the realignment mechanism comprising:

a rotatable sheet pick/feed mechanism defining adjacent thereto a single sheet media feed zone, said pick/feed mechanism including one or more rotatably moveable frictional expanses for engaging a top sheet in a plural-sheet media stack;

a pivotable member operatively coupled with said pick/feed mechanism for at least partial rotation therewith;

said pivotable member having connected therewith a generally radially extending strut;

a drive mechanism for rotating said pivotable member with a predefined first force into various predefined rotational orientations of said pivotable member including a first sheet-feeding orientation;

a pivotal lever extending into said feed zone, said lever nominally traversing said feed zone, said lever being temporarily urged by said strut, upon rotation of said pivotable member, into a non-obstructing orientation that permits feeding by said pick/feed mechanism of the top sheet of the stack by engagement of the top sheet with said expanses; and a return mechanism operatively connected with said lever for returning said lever to said nominally obstructing position within said feed zone upon rotation by said drive mechanism of said member into said first orientation, said lever urging media sheets below the top sheet into substantial leading edge stacked alignment free of said feed zone.

4. The realignment mechanism of claim 3 which further comprises a separator pad closely adjacent said expanses when said member is in said first orientation, said pad having a friction-promoting upper surface for substantially opposing advancement into said feed zone of the media sheets below the top sheet.

5. The realignment mechanism of claim 4, wherein said pad and said lever are laterally adjacent one another.

6. The realignment mechanism of claim 4, wherein said pick/feed mechanism includes one or more spaced rollers equipped with said frictional expanses.

7. The realignment mechanism of claim 6, wherein said lever is dimensioned and oriented such that a distal end thereof pivots in an arc that sweeps fractional volume within a cylinder defined by said rollers.

8. The realignment mechanism of claim 7, wherein said return mechanism provides a second predefined force through such sweeping pivotal arc.

9. The realignment mechanism of claim 8, wherein said second predefined force is variable through such arc.

10. The realignment mechanism of claim 8, wherein said second predefined force is less than said first predefined force at a downstream terminal pivotal arcuate position of said lever, thereby permitting the top sheet while present during feeding thereof to urge said lever into such pivotal position such that said distal end is positioned substantially tangent to such cylinder.

11. The realignment mechanism of claim 10, wherein said strut extends radially outwardly normal to a central rotational axis of said pivotable member to an extent that is approximately equal to a radius defined by such cylinder.

12. In a printer having a single-sheet feed mechanism for feeding a top sheet from a vertical stack of plural such sheets by rotation of two or more laterally spaced rollers defining a cylinder and selectively engaging such top sheet, the improvement comprising:

a radially extending first member rotatably disposed adjacent one such roller, said first member extending outwardly normal to a central axis of such cylinder with its distal end terminating within the radius thereof;

a lever pivotally connected to the printer's chassis, said lever being in lateral alignment with said first member, said lever nominally extending into such cylinder for engagement by said first member when such rollers are in a first predefined rotational orientation, a distal end of said lever being moved by said first member downstream to a position generally tangent to the outer surface of such cylinder; and a return mechanism active when such rollers are in a second predefined rotational orientation to return said lever to such original position as the trailing edge of the top fed sheet clears said lever, the lever urging any sheets that may have been advanced downstream by such rotation back into leading edge alignment in the stack.

13. The improvement of claim 12, wherein said return mechanism includes a spring impacting upon said lever with a variable force thereon such that said lever exerts a lesser return force in a relatively downstream position of said distal end of said lever and a relatively greater return force in a relatively upstream position of said distal end of said lever.

* * * * *